US007890246B2

(12) United States Patent
Ishikawa

(10) Patent No.: US 7,890,246 B2
(45) Date of Patent: Feb. 15, 2011

(54) METHOD OF INTERPOLATING TRAFFIC INFORMATION DATA, APPARATUS FOR INTERPOLATING, AND TRAFFIC INFORMATION DATA STRUCTURE

(75) Inventor: Hiroki Ishikawa, Okazaki (JP)

(73) Assignee: Aisin AW Co., Ltd., Anjo (JP)

( * ) Notice: Subject to any disclaimer, the term of this patent is extended or adjusted under 35 U.S.C. 154(b) by 1503 days.

(21) Appl. No.: 11/002,813

(22) Filed: Dec. 3, 2004

(65) Prior Publication Data

US 2005/0141428 A1 Jun. 30, 2005

(30) Foreign Application Priority Data

Dec. 26, 2003 (JP) ..... 2003-434768
Dec. 26, 2003 (JP) ..... 2003-434789
Sep. 13, 2004 (JP) ..... 2004-265895
Sep. 13, 2004 (JP) ..... 2004-265903

(51) Int. Cl.
*G06G 7/76* (2006.01)
*G08G 1/00* (2006.01)

(52) U.S. Cl. ..... 701/117

(58) Field of Classification Search ..... 340/990, 340/993, 994, 995.1, 995.11, 995.13, 995.14
See application file for complete search history.

(56) References Cited

U.S. PATENT DOCUMENTS 6,317,686 B1 11/2001 Ran
2003/0182051 A1 * 9/2003 Yamamoto ..... 701/200
2004/0038671 A1 * 2/2004 Trayford et al. ..... 455/414.3
2004/0056797 A1 * 3/2004 Knockeart et al. ..... 342/357.13
2004/0225437 A1 * 11/2004 Endo et al. ..... 701/209

FOREIGN PATENT DOCUMENTS

| | | | |
|---|---|---|---|
| CA | 2 480 474 | | 10/2003 |
| JP | 07129893 | * | 5/1995 |
| JP | A 08-191290 | | 7/1996 |
| JP | A 2000-076593 | | 3/2000 |
| JP | A 2000-242883 | | 9/2000 |
| JP | A 2000-259978 | | 9/2000 |
| JP | A 2000-304557 | | 11/2000 |
| JP | A 2002-148067 | | 5/2002 |
| JP | A 2002-260145 | | 9/2002 |
| JP | A 2002-373393 | | 12/2002 |
| WO | WO 2004/021305 A | | 3/2004 |

* cited by examiner

*Primary Examiner*—Jack Keith
*Assistant Examiner*—Imran Mustafa
(74) *Attorney, Agent, or Firm*—Oliff & Berridge, PLC

(57) ABSTRACT

Systems and methods of interpolating traffic information data may accumulate, for each link, a link travel time and a congestion degree at a plurality of trip times. The systems and methods may determine, for each link, whether at least one of the link travel time and the congestion degree properly exists at each of the plurality of trip times, and may interpolate, for each non-existent at least one of the link travel time and the congestion degree, an acceptable value.

10 Claims, 6 Drawing Sheets

METHOD OF INTERPOLATING TRAFFIC INFORMATION DATA, APPARATUS FOR INTERPOLATING, AND TRAFFIC INFORMATION DATA STRUCTURE

INCORPORATED BY REFERENCE

The disclosure of Japanese Patent Application Nos. 2003-434768 filed on Dec. 26, 2003, 2004-265895 filed on Sep. 13, 2004, 2003-434789 filed on Dec. 26, 2003, and 2004-265903 filed on Nov. 13, 2004, including the specifications, drawings, and abstracts are incorporated herein by reference in their entirety.

BACKGROUND

1. Related Fields

Related fields include methods of interpolating traffic information data, apparatus for interpolating, and traffic information data structures.

2. Description of the Related Art

Japanese Patent Application Laid-Open No. 2002-148067 discloses a navigation method of accumulating received traffic information, time and date, and day of the week and finding a shortest route or calculating a travel time with the aid of the accumulated data.

In the aforementioned navigation method, however, the received traffic information is not always normally provided for all the links. Thus, for example, missing data and the like, may occur. Using such unreliable stored data can undermine the reliability of searching route.

SUMMARY

Accordingly, it is beneficial to provide a method apparatus and data structure of interpolating traffic information data that may interpolate blank data if data does not exist. The method may further interpolate effective data for the blank data. Furthermore, the present invention provides the interpolation apparatus and the traffic information data structure.

Various exemplary implementations provide a method of interpolating traffic information data including accumulating, for each link, a link travel time and a congestion degree at a plurality of trip times. The method may include determining, for each link, whether at least one of the link travel time and the congestion degree properly exists at each of the plurality of trip times, and interpolating, for each non-existent at least one of the link travel time and the congestion degree, an acceptable value.

Various exemplary implementations provide a system for interpolating traffic information data that may include a memory that accumulates, for each link, a link travel time and a congestion degree at a plurality of trip times and a controller. The controller may determine, for each link, whether at least one of the link travel time and the congestion degree properly exists at each of the plurality of trip times, and may interpolate, for each non-existent at least one of the link travel time and the congestion degree, an acceptable value.

Various exemplary implementations provide a traffic information data structure including for each link, a link travel time and a congestion degree at a plurality of trip times. At least one of the link travel times and congestion degrees is determined by interpolating link travel time data and/or congestion degree data.

BRIEF DESCRIPTION OF THE DRAWINGS

Exemplary implementations will now be described with reference to the accompanying drawings, wherein.

DETAILED DESCRIPTION OF EXEMPLARY IMPLEMENTATIONS

Figure 1:
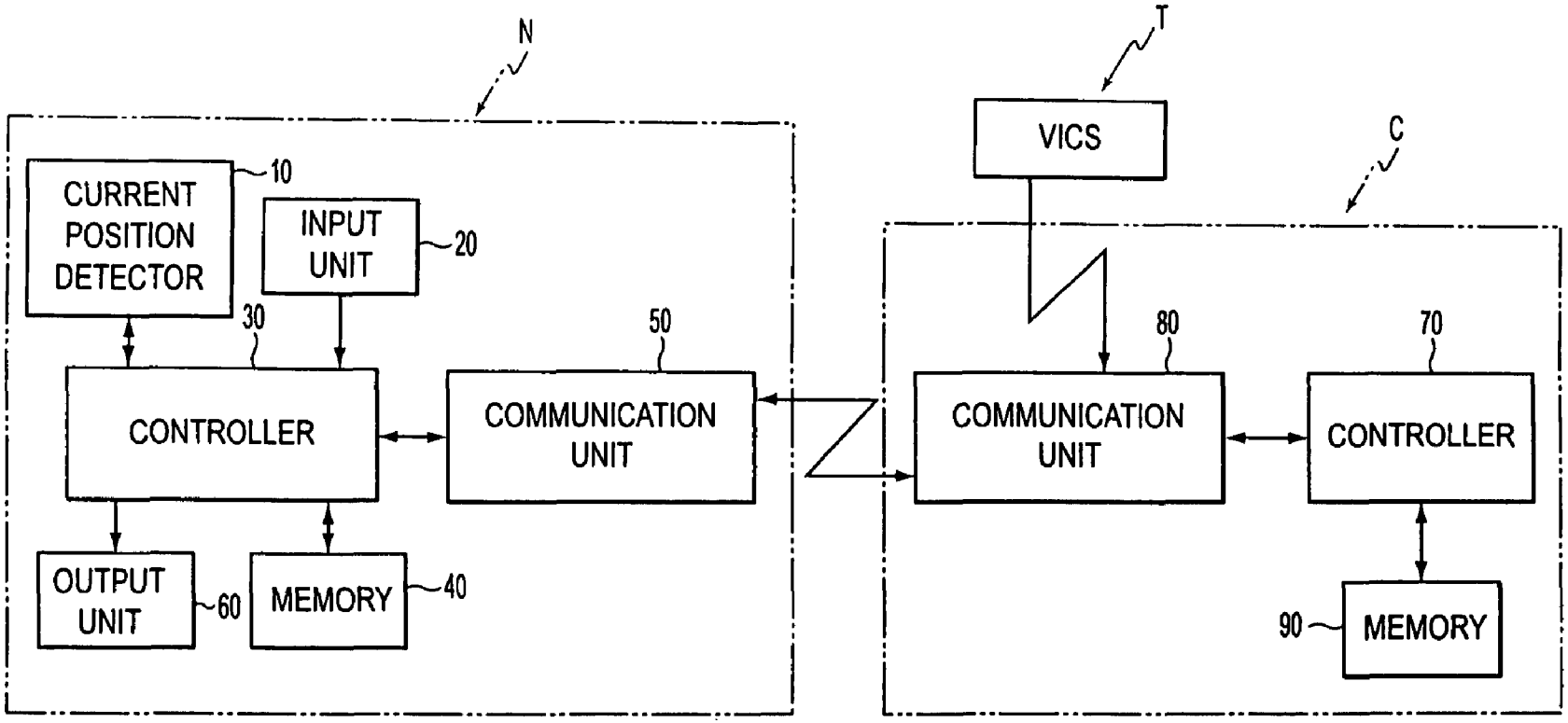
FIG. 1 is a block diagram showing an exemplary traffic information data interpolation device.

FIG. 1 is a block diagram showing an exemplary traffic information data interpolation device. This system may be physically, conceptually, or functionally divided into, for example, a navigation apparatus N and an information communication system C, for example, provided in an information center. The navigation system N that may be mounted in a vehicle. Further, FIG. 1 shows a road traffic information communication system T (hereinafter also referred to as VICS®) that may be provided in a road traffic information center.

The navigation system N may be provided with a current position detector 10 (such as, for example, a GPS receiver). The current position detector 10 may receive radio waves sent from an artificial satellite of a satellite navigation system (also known as GPS) to detect a current position of a vehicle as well as a present day and time.

In addition, the navigation system N may be provided with an input unit 20. The input unit 20 may be, for example, a portable remote controller that may send required information to a controller 30 (described later). The input unit 20 may also be, for example, a touch panel provided on a display screen of a display device. Such a display device may be part of an output unit 60 (described later).

Furthermore, the navigation system N may be provided with, for example, a controller 30, a memory 40, a communication unit 50, and/or an output unit 60. The controller 30 may consist of, for example, a CPU, a RAM, and/or a ROM and may be connected by, for example, bus lines.

The controller 30 may control, for example, map display, route search, and/or route guidance of the vehicle based upon, for example, a current position that is obtained by, for example, the current position detector 10, operation of the input unit 20, information in the memory 40, communication from communication unit 50, and/or information from the information communication system C.

The memory 40 may be, for example, a hard disk. Map data and/or traffic information data may be accumulated in the memory 40. The communication unit 50 may receive, for example, road traffic information from the information communication system C to output to the controller 30.

The information communication system C may include, for example, a controller 70, a communication unit 80, and/or the memory 90. The communication unit 80 may execute wireless communication between the communication unit 50 and VICS T. The controller 70 may execute, for example, the exemplary methods shown in the flowcharts in FIGS. 2 to 6. The controller 70 may also control the transfer of information between, for example, the communication unit 50 and VICS T via, for example, the communication unit 80. Note that, control programs may be stored in advance in, for example, a ROM of the controller 70.

Link travel times TT, vehicle speeds, congestion degrees D, and/or traffic information data (such as, for example, roads closed to traffic and traffic regulations) may be sent from VICS T and stored in the memory 90. A congestion degree D is a degree of traffic congestion determined by a vehicle speed and the congestion degree may consist of four-stage data, that is, for example, "congested," "crowded," "not congested," and "uncertain." According to this example, the degree of congestion decreases in the order of "congested," "crowded," and "not congested." The congestion degree is not limited to four stages and may consist of a plurality of stages.

Further, a VICS link length may be stored in the memory 90 as map data. The VICS link length is an actual length of a target link.

As used herein, the term link refers to, for example, a road or portion of a road. For example, according to one type of road data, each road may consist of a plurality of componential units called links. Each link may be separated and defined by, for example, an intersection, an intersection having more than three roads, a curve, and/or a point at which the road type changes. A link travel time TT is the amount of time necessary to travel a particular link.

The output unit 60 may be, for example, a display unit. Under the control of the controller 30, the output unit 60 may display data A display panel, such as, for example, a liquid crystal panel of the output unit 60 may be disposed in an instrument panel that is provided in a front wall in a cabin of the vehicle.

According to the above described example, the information communication system C may execute various methods for interpolating VICS data which may be, for example, received from VICS T, as follows.

Figure 2:
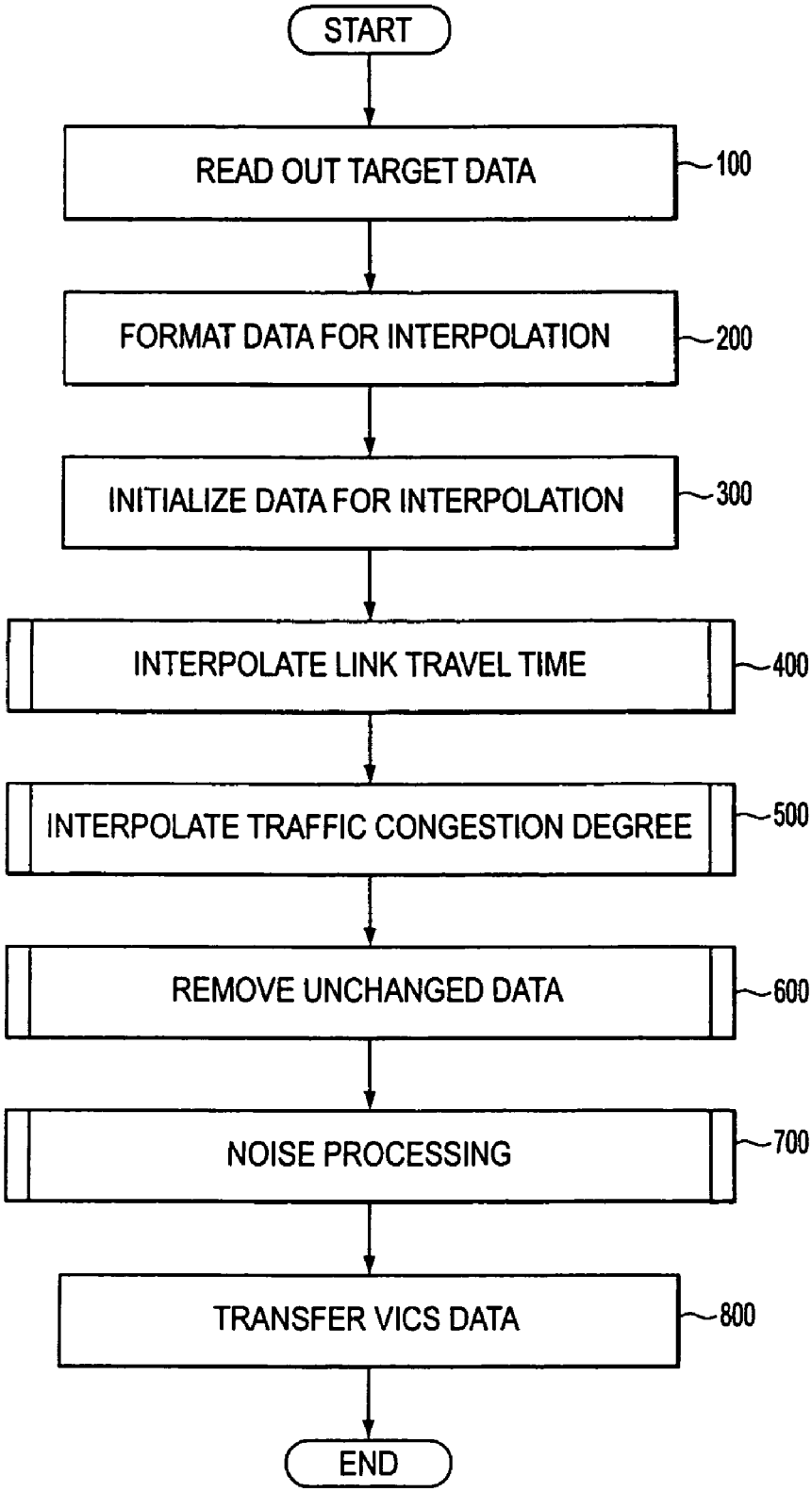
FIG. 2 is a flowchart showing an exemplary method of interpolating traffic data.

According to one such exemplary method for interpolating VICS data shown in FIG. 2, target data may be readout from, for example, the memory 90 in step 100. Thus, for example, a link travel time TT, a congestion degree D, and a VICS link length L are read out from, for example, the memory 90 for each link at a plurality of trip times.

As used herein, the term "trip time" refers to the time at which a link may be traveled. This is because a travel time for a particular link may vary depending on the time of day, day, and/or time of year. For example, trip times may be set as predefined intervals such as, for example, 12 PM-2 PM. Accordingly, a trip time previous to the 12 PM-2 PM trip time may be 10 AM-12 PM or 6 AM-8 AM. The trip times may be defined by large or small intervals and may also be defined by or grouped into events, such as "morning rush hour," "evening rush hour," or "weekend."

Next, VICS data may be formatted for interpolation in step 200. Because a link travel time TT and a congestion degree D are needed for each link, blank data may be created for a link in which link travel time TT data or congestion degree D data does not exist or is unavailable at one or more trip times.

Thereafter, the formatted VICS data may be initialized for interpolation in step 300. Thus, for example, "no data" may be input in the blank data of the link travel time TT created in step 200. Further, for example, "uncertain" may be input in the blank data of the congestion degree D.

In this manner, even if a part of VICS data for a link is missing, blank data may be created for the link. Thus, blank data may exist in the VICS data. Accordingly, all of VICS data may be interpolated based upon the blank data, in step 400.

Figure 3:
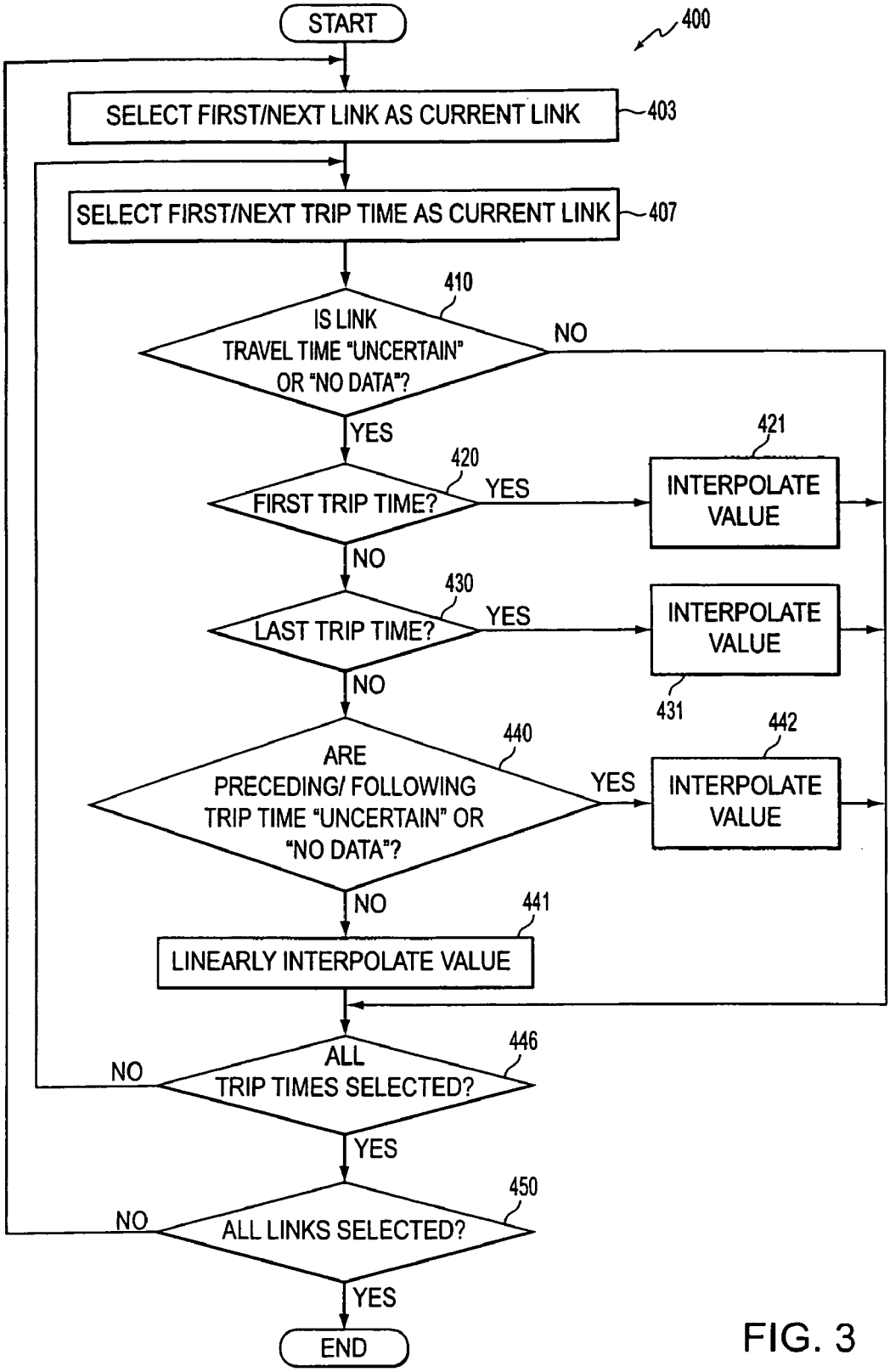
FIG. 3 is a flow chart showing an exemplary method of interpolating link travel time.

FIG. 3 shows an exemplary method of interpolating link travel time is for each link. First, the first/next link is selected as the current link in step 403. Then, in step 407, a first/next trip time for the current link is selected. Next, it is determined whether a link travel time TT for the current link and current travel time is "uncertain" or "no data" in step 410. For example, if the link travel time TT at the current trip time is neither "uncertain" nor "no data," then operation proceeds to step 446. If the link travel time TT for the current link and current trip time is "uncertain" or "no data," operation proceeds to step 420. In step 420, it is determined whether the current trip time is the first trip time for the current link. If the trip time is the first trip time, the travel time TT is interpolated in step 421. In step 421, a same value as a link travel time TT which is neither "uncertain" or "no data" and which is the travel time TT for the nearest following trip time for the current link is interpolated as the link travel time TT for the current link at the current trip time. Operation proceeds to step 446.

If the current trip time is not the first trip time for the current link, it is determined whether the current trip time is the last trip time for the current link in step 430. If the current trip time is the last trip time, the travel time TT is interpolated in step 431. In step 431, a same value as a link travel time TT which is neither "uncertain" or "no data" and which the travel time TT for the nearest preceding trip time is interpolated as the link travel time for the current link at the current trip time. Operation proceeds to step 446.

If the trip time link is not the last trip time for the current link, operation continues to step 440. In step 440, it is determined whether link travel times TT for a preceding trip time and/or a following trip time are "uncertain" or "no data."

If the link travel times TT for a preceding trip time and a following trip time are neither "uncertain" or "no data," the travel time TT of the current link at the current trip time is linearly interpolated in step 441. In step 441, a result of the linear interpolation between the travel times TT of the preceding trip time and the following trip time is set as the link travel time TT of the current link at the current trip time. Operation proceeds to step 446.

If the link travel time TT for the preceding trip time or following trip time is "uncertain" or "no data," the travel time TT of the current link at the current trip time is interpolated in step 442. In step 442, if the link travel time TT at the preceding trip time is "uncertain" or "no data," the travel time TT for the current link at the current trip time is linearly interpolated between the travel time TT of the following trip time and a trip time for the current link whose travel time TT is neither "uncertain" or "no data" and which is the nearest preceding trip time to the current trip time.

If the link travel time TT for the following trip time is "uncertain" or "no data," the travel time TT for the current link at the current trip time is linearly interpolated between the travel time TT of the preceding link and a trip time whose travel time TT is neither "uncertain" or "no data" and which is the nearest following trip time to the current trip time.

Next, in step 446, it is determined whether all trip times for the current link have been selected as the current trip time. If all trip times have not been selected, then operation returns to step 407. If all trip times have been selected, operation continues to step 450.

In step 450, it is determined whether all links in the target data have been selected as the current link in step 450. If all links have not been selected, then operation returns to step 403. If all links have been selected, operation terminates.

As described above, if any travel time TT for a link in the target data is "uncertain" or "no data," execution of interpolation processing between link travel times TT at a preceding trip time and a following trip time result in an effective link travel time. Thus, data quality of VICS data is improved after the above mentioned processing.

Figure 4:
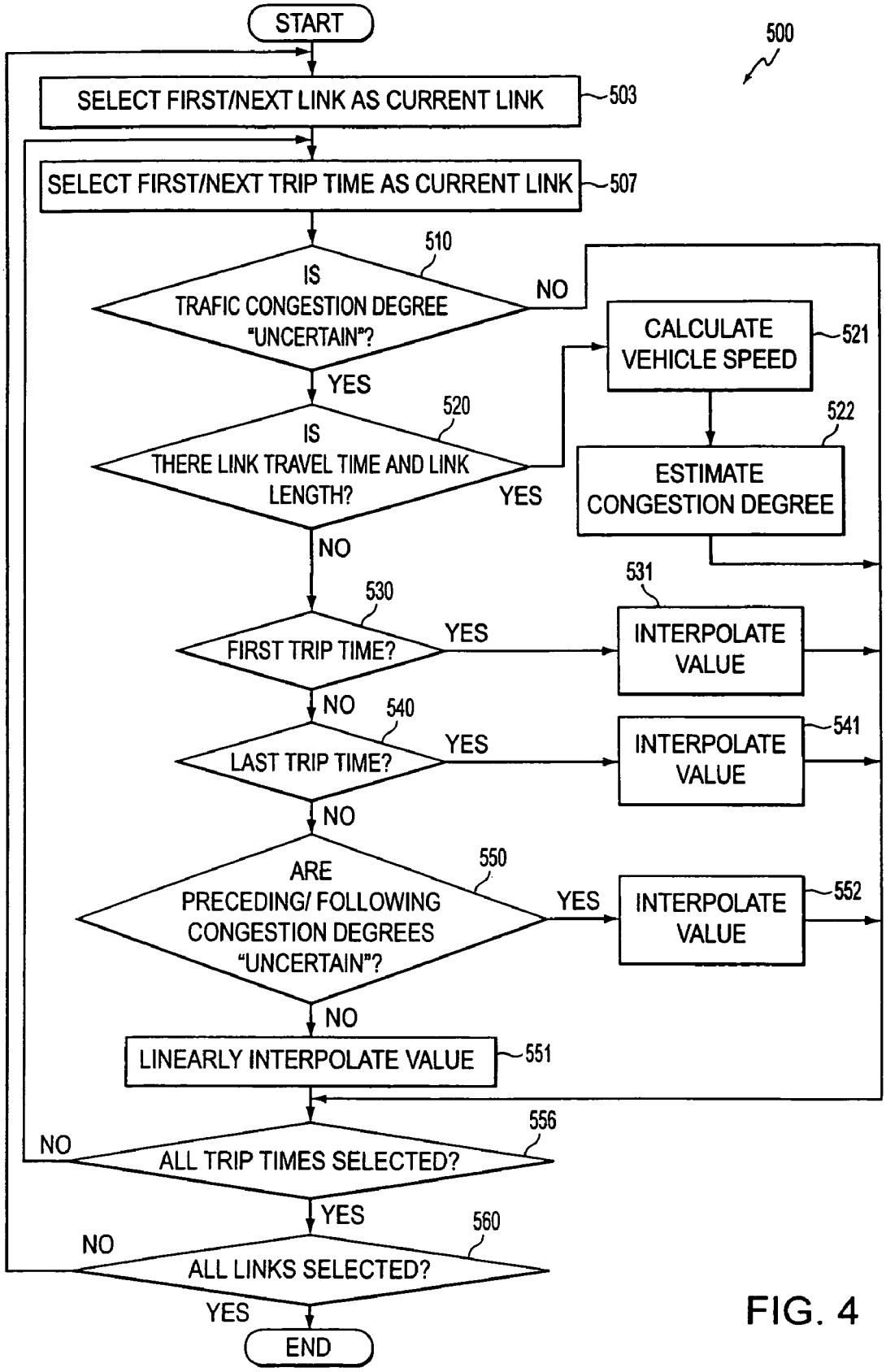
FIG. 4 is a flow chart showing an exemplary method of interpolating congestion.

Returning to FIG. 2, in step 500, traffic congestion may be interpolated for each link. FIG. 4 shows an exemplary method of interpolating traffic congestion. First, in step 503, a first/next link is selected as the current link. Then, in step 507, a first/next trip time for the current link is selected as the current trip time. Next, it is determined whether a congestion degree D of the current trip time of the current link is "uncertain" in step 510. If the congestion degree D is not "uncertain," operation proceeds to step 556.

If the congestion degree D is "uncertain," operation proceeds to step 520. In step 520, it is determined whether there is travel time TT and a link length L for the current trip time of the current link. If there is a link travel time TT and a link length L, a vehicle speed V is calculated in step 521. The vehicle speed V may be calculated by, for example, equation 1.

$$V=L/TT \tag{1}$$

Next, in step 522, a congestion degree is estimated for the current trip time of the current link. Congestion degrees D may be estimated as follows by using, for example, vehicle speeds V and road types (for example, general road, urban highway, and intercity highway). The setting of congestion degrees D may be based upon, for example, Table 1.

TABLE 1

| | Congested | Crowded | Not congested |
|---|---|---|---|
| General road | $V \leqq 10$ km/h | 10 km/h $< V \leqq 20$ km/h | 20 km/h $< V$ |
| Urban highway | $V \leqq 20$ km/h | 20 km/h $< V \leqq 40$ km/h | 40 km/h $< V$ |
| Intercity highway | $V \leqq 40$ km/h | 40 km/h $< V \leqq 60$ km/h | 60 km/h $< V$ |

According to Table 1, a vehicle speed V may be specified according to a relationship between a road type and a congestion degree D. The data in Table 1 may be, for example, stored in a ROM of the controller 30 in advance.

According to Table 1, for example, if a road type of the current link is a general road and a vehicle speed is V=15 km/h, a congestion degree D may be set as "congested."

If there is no link travel time TT and a link length L for the current trip time of the current link, operation continues to step 530. In step 530, it is determined whether the current trip time is the first trip time. If the current trip time is the first trip time, operation continues to step 531 where the congestion degree D is interpolated. In step 531, the congestion degree D of the nearest following trip time of the current link that is not "uncertain" is set as the congestion degree D of the current link. Operation proceeds to step 556.

If the current trip time is not the first trip time of the current link, it is determined whether the current trip time is the last trip time of the current link in step 540. If the current trip time is the last trip time, operation continues to step 541, where the congestion degree D is interpolated. In step 541, the congestion degree D of the nearest preceding trip time that is not "uncertain" is set as the congestion degree D of the current trip time for the current link. Operation proceeds to step 556.

If the current trip time is not the last trip time, it is determined whether the congestion degrees D for a preceding trip time and a following trip time are "uncertain" in step 550. If the congestion degrees D for the preceding trip time and the following trip time are not "uncertain," the congestion degree D of the current trip time for the current link is linearly interpolated in step 551. Thus, for example, the average value between the congestion degrees D at the preceding trip time and the following trip time is set as the congestion degree D at the current trip time of the current link.

For example, if the average value is between "congested" and "crowded," the congestion degree D may be set as the lower level, that is, "crowded." If the average value is between "crowded" and "not congested," the congestion degree D may be set as "not congested."

If the congestion degree D for the preceding trip time or the following trip time is "uncertain," the congestion degree D of the current trip time is interpolated in step 552. For example, if the congestion degree for the preceding trip time is "uncertain," for example, the average value between a congestion degree D of the nearest preceding trip time that is not "uncertain" and a congestion degree D for the following trip time is set as the congestion degree D for the current trip time of the current link. If the congestion degree for the following trip time is "uncertain," for example, the average value between a congestion degree D of the nearest following trip time that is not "uncertain" and a congestion degree D at the preceding trip time is set as the congestion degree D for the current trip time of the current link. According to the example, if the average value is between "congested" and "crowded" or between "crowded" and "not congested," the congestion degree D may be set as lower level. Operation continues to step 556.

In step 556, it is determined whether all of the trip times for the current link have been selected as the current trip time. If all of the trip times have not been selected, operation returns to step 507. If all the trip times have been selected, operation continues to step 560.

In step 560, it is determined whether all of the trip times for the current link have been selected as the current trip time. If all of the trip times have not been selected, operation returns to step 507. If all the trip times have been selected, operation continues to step 560.

In step 560, it is determined whether all of the links in the target data have been selected as the current link. If all of the links have not been selected, operation returns to step 510. If all the links have been selected, operation ends.

Thus, if a congestion degree D is "uncertain," for a particular link, an effective congestion degree D may be determined by interpolating between congestion degrees D for preceding and/or following trip times. In addition, a congestion degree D may be calculated based upon a vehicle speed V calculated from a link travel time TT and a link length L. Even if a congestion degree D is interpolated based on a calculated value, the quality of the congestion data is improved.

Figure 5:
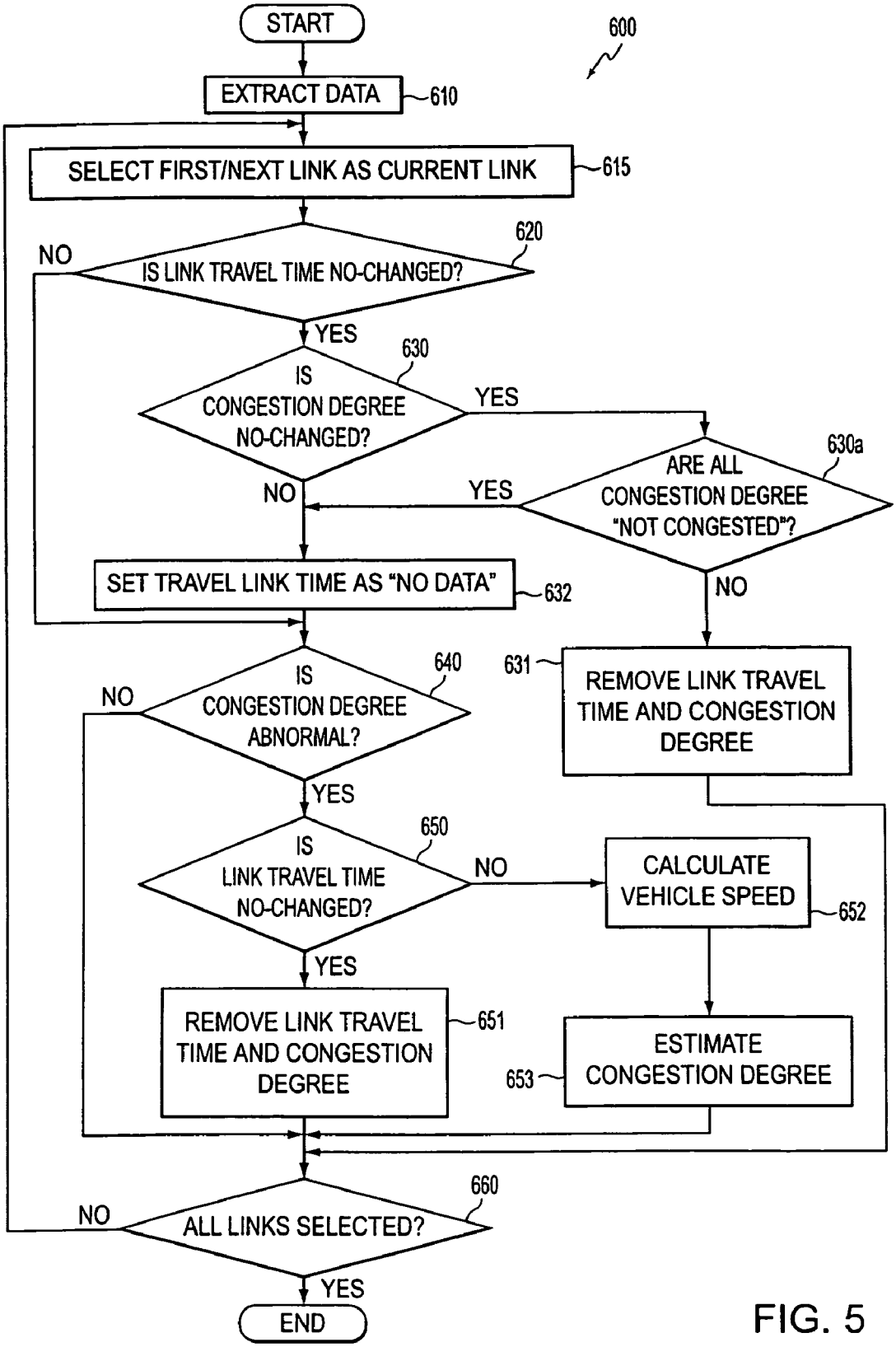
FIG. 5 is a flow chart showing a no-changed VICS data remove processing routine of in FIG. 2.

Returning to FIG. 2, in step 600, link data that has not changed over a predetermined period of time is identified and corrected and/or reset. FIG. 5 shows an exemplary method of correcting link data. First, in step 610, link data is extracted for each link of the target data over the predetermined time period. Thus, for example, link travel times TT, congestion degrees D, and link lengths L for each link during the predetermined time period are extracted from the memory 90. Note that, the predetermined time period may be, for example, a day, a month or any other time period. The predetermined time period may include one or more trip times.

Next, in step 615, a first/next link is selected as the current link. Then, in step 620, it is determined whether the link travel time TT of the current link is the same over the predetermined time period. If all of the link travel times TT for the current link are the same over the predetermined time period of the target link are same value, operation continues to step 630.

In step 630, it is determined whether a congestion degree D of the current link has not changed over the predetermined time period. If all congestion degrees D of the current link are unchanged over the predetermined time period, operation continues to step 630*a*.

In step 630*a*, it is determined whether all of the congestion degrees D for the current link over the predetermined time period are "not congested." If all congestion degrees D for the current link over the predetermined time period are the same and "not congested," operation continues to step 631.

In step 631, all travel time TT data and congestion degree D data for the current link over the predetermined time period are removed. Operation proceeds to step 660. However, in step 630*a*, if all congestion degrees D for the current link over the predetermined time period are "not congested," operation proceeds to step 632. Similarly, if the congestion degree D is not the same in step 630, operation proceeds to step 632.

In step 632, all link travel times TT of the current link over the predetermined time period are set as "no data." Operation proceeds to step 640. If all link travel times TT for the current link over the predetermined time period are not same value, in step 620, operation proceeds to step 640.

In step 640, it is determined whether the congestion degrees D for the current link over in the predetermined time period are abnormal. The congestion degrees D for the current link over the predetermined time period may be considered abnormal if all of the congestion degrees are, for example, the same and in one of any levels of "congested," "crowded," or "uncertain." For example, if all congestion degrees D for the current link over the predetermined time period are "congested," they may be considered abnormal. If they are abnormal, operation proceeds to step 650. If all congestion degrees D for the current link over the predetermined time period are not abnormal, operation proceeds to step 660.

In step 650, it is determined whether link travel times TT for the current link over the predetermined time period are not changed. For example, if all link travel times TT for the current link over the predetermined time period are a same value, there is no change and operation continues to step 651.

In step 651, all link travel time TT data and congestion degree D data for the current link over the predetermined time period are removed. Operation proceeds to step 660.

If link travel times TT for the current link over the predetermined time period are not changed in step 650, a vehicle speed is calculated in step 652. For example, vehicle speeds V may be calculated from, for example, link travel times TT and link lengths L based upon Equation 1.

Then, in step 653, congestion degrees D may be set by using, for example, road types and vehicle speeds V based upon the data as described in table 1.

In step 660, it is determined whether all links have been selected as the current link. If all links have not been selected, operation returns to step 615. If all links have been selected, operation ends.

According to the above described exemplary method, VICS data which has no change over a predetermined time period may be considered conspicuously incorrect and may be deleted or corrected so that only effective and reliable VICS data remains. Thus, the quality of VICS data is enhanced.

Figure 6:
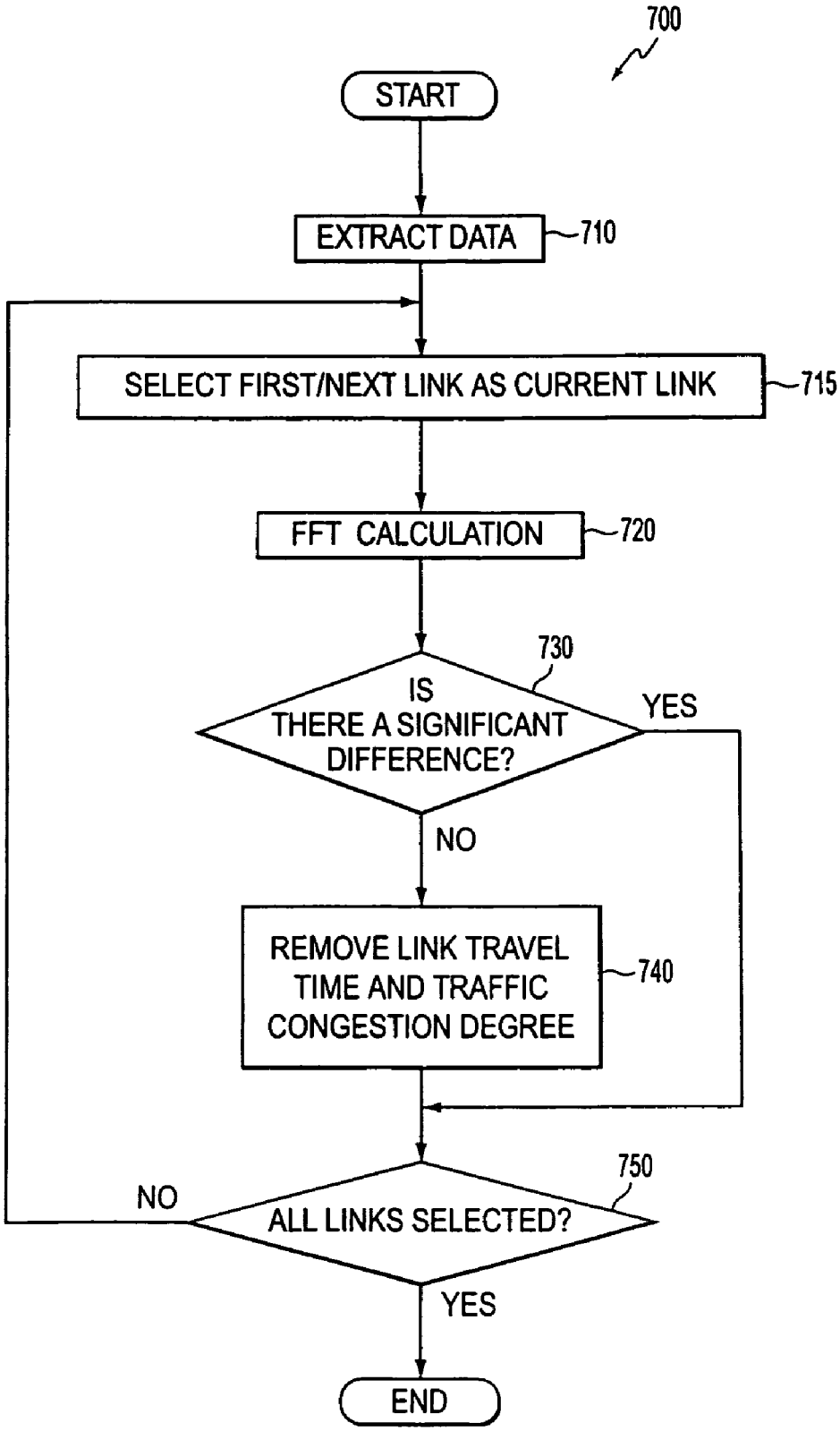
FIG. 6 is a detailed flow chart of a noise VICS data remove processing routine of in FIG. 2.

Returning to FIG. 2, in step 700, the signal strength is evaluated for each link as follows. FIG. 6 shows an exemplary method of evaluating the signal strength for each link. First in step 710, data is extracted for each predetermined time period of each link. Thus, for example, link travel times TT and congestion degrees D for each link over a predetermined time period are extracted from the memory 90. Note that, the predetermined time period may be, for example, a day, a month, or any other time period.

Next, in step 715, a first next link is selected as the current link. Then, in step 720, a frequency analysis (FA) for link travel times TT for the current link over the predetermined time period is executed and a frequency range of a signal section and a noise section are calculated.

Then, in step 730, it is determined whether there is a significant difference between the calculated frequency range of the signal section and the frequency range of the noise section for the current link. For example, if a S/N ratio of the signal section and noise section according to frequency range 300 μHz is not less than 20 dB, there may be considered a significant difference, and operation proceeds to step 750.

If there is no significant difference between a frequency range of the signal section and a frequency range of the noise section, operation continues to step 740. In step 740, all link travel times TT for the current link over the predetermined time period are removed.

In step 750, it is determined whether all links have been selected as the current link. If all links have not been selected, operation returns to step 715. If all links have been selected, operation ends.

According to the above described exemplary method, if a S/N ratio of a link travel time TT for the current link over a predetermined time period is low and it is determined there is no significant difference, the link travel time TT for the current link over the predetermined time period is removed. Thus, the quality and reliability of VICS data is enhanced.

Returning to FIG. 2, in step 800, once the VICS data has been interpolated (steps 400 and 500) and evaluated (steps 600 and 700), for example, the controller 70 transfers the interpolated VICS data to, for example, the controller 30 via, for example, the communication unit 80 and the communication unit 50. The received VICS data may be stored in, for example, the memory 40.

The controller 30 may search for a route based upon, for example, a display request by the input unit 20. Based on the above-described exemplary methods, the controller 30 may perform route search with accurate congestion prediction based upon-reliable VICS data and it is possible for the navigation system N to perform reliable route guidance.

Note that the methods described above are merely examples. Various modifications are possible without departing from the broad spirit and the scope of the invention.

For example, in step 200, it is possible to format the VICS data limited to predetermined time period, for example, by a month, a day, or couple hours. In step 551, an acceptable value between congestion degrees of preceding and following links may be interpolated. However, it is also possible to interpolate a congestion degree D based upon congestion areas that are sent from VICS T with congestion degrees D and stored in the memory 90, for example, congestion lengths. For example, if a target time, and a preceding or following time are in a same traffic congestion area, it is possible to use a same congestion degree at the target time as the congestion degree at the preceding or following time.

In step 100 to 700, the information communication system C may receive VICS data sent from the information center. However, it is also possible to execute the methods if the navigation system N directly receives VICS data from the road traffic information center.

In step 200, since link travel time TT data and congestion degree D data are needed for each time-period, blank data is created on a link in which link travel time TT data or congestion degree D data does not exist. After that, "no data" may be input in blank data of link travel time TT and "uncertain" may be input in blank data of congestion degree D in step 300. However, it is possible to input "no data" directly for a link in which link travel time TT data does not exist. It is also possible to input "uncertain" directly for a link in which congestion degree D data does not exist.

Note that although the linear interpolation may be used, for example, an average value, medium value, or some other approximation may be used in place of the linear interpolation.

Hereinafter, another example will be described (hereinafter also referred to as second embodiment of the invention) In the conventional navigation method, the traffic information is not always reliably provided. Thus, incorrect data such as a link travel time or congestion degree which has no change can exist in certain time period. Using such unreliable data may undermine the reliability of route searching. Thus, it is beneficial to provide a method of correcting traffic information data that corrects link travel time data or congestion degree data which has no change in a predetermined time period, an apparatus for correcting, and a traffic information data structure.

Accordingly, there may be provided a method of correcting traffic information data, including accumulating traffic information data including a link travel time (TT) and a congestion degree (D) for each link as well as time information, and checking whether there is any change in the link travel time data of each link over a predetermined time period. As the result, link travel time data which has no change may be corrected. In this manner, according to accumulated link travel time and congestion degree, as described above, link travel times which have no change over a predetermined time period may be corrected. Therefore, conspicuously incorrect link travel time data which has no change in a predetermined time period is corrected thereby enhancing a quality of data.

In addition, the aforementioned exemplary method of correcting traffic information data may correct a link travel time based upon a congestion degree corresponding to the link travel time. In this manner, even if it is determined that there is no change in the link travel time, the travel time may be corrected based upon the congestion degree corresponding to the link travel time, an effect identical to the invention according to the aspect as described above can be obtained.

Further, the aforementioned method of correcting traffic information data checks whether there is any change with congestion degree data corresponding to the link travel time. As the result of the checking, if the congestion degree has no change, the congestion degree and the link travel time corresponding to the congestion degree are removed. In this manner, if it is determined that a congestion degree has no change as well as a corresponding link-travel time, the link travel time and the congestion degree for the predetermined time period are removed. As the result of the removing, an effect similar to the first example can be improved and obtained.

Further, the aforementioned method of correcting traffic information data checks whether there is any change with congestion degree data corresponding to a link travel time. As the result of the checking, if the congestion degree has a change, the link travel time corresponding to the congestion degree is corrected to "no data." In this manner, if it is determined that a congestion degree has a change although a corresponding link travel time has no change, the link travel time in a predetermined time period is corrected to "no data." As the result of the correction, an effect similar to the first example can be improved and obtained.

Furthermore, the method of correcting traffic information data related to this example may be characterized by accumulating traffic information data including a link travel time (TT) and a congestion degree (D) for each link as well as time information, and checking whether there is any change with congestion degree data in a predetermined time period for a link. As the result of the checking, congestion degree data which has no change is removed. In this manner, according to accumulated link travel time and congestion degree as described above, congestion degrees which have no change in a predetermined time period of a target link are removed. Therefore, conspicuously incorrect congestion degree data which have no change in a predetermined time period are removed thereby enhancing a quality of data.

Further, the method of correcting traffic information data related to this example may be characterized by accumulating traffic information data including a link travel time (TT) and a congestion degree (D) for each link as well as time information, and calculating a S/N ratio of link travel time data in a predetermined time period for each link. If the S/N ratio is lower than a predetermined value, the link travel time data is removed. In this manner, according to accumulated link travel time and congestion degree as described above, if it is determined that a S/N ratio of a link travel time in a predetermined time period of a target link is lower than a predetermined value, the link travel time in the predetermined time period is removed. Therefore, conspicuously incorrect link travel time data which are lower than a predetermined value in a predetermined time period can be removed thereby enhancing a quality of data.

Further, in the second example, the method of correcting traffic information data includes accumulating traffic information data including a link travel time (TT) and a congestion degree (D) for each link as well as time information and the method of correcting (steps 631, 632, and 651), checking whether there is any change with link travel time data in a predetermined time period of each link (step 620), and correcting link travel time data which has no change as the result of the checking. In this manner, according to accumulated link travel time and congestion degree as described above, link travel times which have no change in a predetermined time period are corrected. Therefore, conspicuously incorrect link travel time data which has no change in a predetermined time period can be changed thereby enhancing a quality of data.

Further, the traffic information data structure related to the second example is characterized by accumulating traffic information data including a link travel time (TT) and a congestion degree (D) for each link as well as time information. Further, link travel time data which has no change is corrected and created in a predetermined time period for each link. In this manner, according to accumulated link travel time and congestion degree as described above, link travel times which have no change in a predetermined time period are corrected and created. Therefore, conspicuously incorrect link travel time data which has no change in a predetermined time period can be changed thereby enhancing a quality of data.

Further, the traffic information data structure related to this example may be characterized by accumulating traffic information data including a link travel time (TT) and a congestion degree (D) for each link as well as time information. Further, congestion degree data which have no change may be removed and created in a predetermined time period for each link. In this manner, according to accumulated link travel time and congestion degree as described above, congestion degrees which have no change in a predetermined time period of a target link may be removed and created. Therefore, conspicuously incorrect congestion degree data which has no change in a predetermined time period can be removed thereby enhancing a quality of data.

Further, the traffic information data structure related to this example is characterized by accumulating traffic information data including a link travel time (TT) and a congestion degree (D) for each link as well as time information. Further, the traffic information data structure is produced by removing congestion degree data which has no change and whose S/N ratio is lower than a predetermined value in a predetermined time period for each link. In this manner, according to accumulated link travel time and congestion degree as described above, if it is determined that a S/N ratio of a link travel time in predetermined time period of a target link is lower than a predetermined value, the traffic information data structure is produced by removing the link travel time in the predetermined time period. Therefore, conspicuously incorrect link travel time data whose S/N ratio is lower than a predetermined value in a predetermined time period can be removed thereby enhancing a quality of data.

While various features have been described in conjunction with the examples outlined above, various alternatives, modifications, variations, and/or improvements of those features may be possible. Accordingly, the various examples, as set forth above, are intended to be illustrative. Various changes may be made without departing from the broad spirit and scope of underling principles.

What is claimed is:

1. A method of interpolating traffic information data, comprising:

accumulating traffic information for a link at a plurality of trip times;

using a controller to:

determine whether the traffic information exists for a single link at each of the plurality of trip times;

determine whether a trip time at which the traffic information for the single link does not exist is a first trip time of the plurality of trip times;

interpolate, if the trip time at which the traffic information does not exist is the first trip time, traffic information of the trip time at which the traffic information does not exist as traffic information for the single link of a nearest following trip time;

determine whether the trip time at which the traffic information for the single link does not exist is a last trip time of the plurality of trip times;

interpolate, if the trip time at which the traffic information does not exist is the last trip time, the traffic information of the trip time at which the traffic information does not exist as traffic information for the single link of a nearest preceding trip time; and interpolate, if the trip time at which the traffic information does not exist is not the first trip time and not the last trip time, the traffic information of the trip time at which the traffic information does not exist as traffic information based on the traffic information for the single link of the nearest following trip time and the traffic information for the single link of the nearest preceding trip time.

2. The method of claim 1, further comprising:

creating blank data as the traffic information for the trip time at which the traffic information does not exist.

3. The method of claim 2, wherein:

creating the blank data comprises assigning an "uncertain" or "no data" value for the traffic information for the trip time at which the traffic information does not exist.

4. The method of claim 2, wherein the interpolating comprises interpolating the blank data.

5. The method of claim 4, wherein the interpolating comprises interpolating an acceptable congestion degree for the blank data.

6. The method of claim 1, wherein:

the traffic information is at least one of a link travel time and a congestion degree.

7. The method of claim 6, wherein:

determining whether the traffic information exists at each of the plurality of trip times comprises determining whether there is an uncertain congestion degree; and interpolating, if there is an uncertain congestion degree, an acceptable value.

8. The method of claim 6, wherein:

interpolating, if the trip time at which the congestion degree does not exist is not the first trip time and not the last trip time, the congestion degree of the trip time as congestion degree based on an average of a congestion degree of the nearest following trip time and a congestion degree of the nearest preceding trip time.

9. The method of claim 8, wherein:

the average between the congestion degree of the nearest preceding trip time and the congestion degree of the nearest following trip time comprises setting the average as a lower congestion degree if the congestion degree of the preceding trip time and the congestion degree of the following trip time are within one degree on a congestion scale.

10. A system for interpolating traffic information data, comprising:

a means for accumulating traffic information for a link at a plurality of trip times;

a means for determining with a controller whether the traffic information for a single link exists at each of the plurality of trip times;

a means for determining with the controller whether a trip time at which the traffic information for the single link does not exist is a first trip time of the plurality of trip times;

a means for interpolating with the controller, if the trip time at which the traffic information does not exist is the first trip time, traffic information of the trip time at which the traffic information does not exist as traffic information for the single link of a nearest following trip time;

a means for determining with the controller whether the trip time at which the traffic information for the single link does not exist is a last trip time of the plurality of trip times;

a means for interpolating with the controller, if the trip time at which the traffic information does not exist is the last trip time, the traffic information of the trip time at which the traffic information does not exist as traffic information for the single link of a nearest preceding trip time; and a means for interpolating with the controller, if the trip time at which the traffic information does not exist is not the first trip time and not the last trip time, the traffic information of the trip time at which the traffic information does not exist as traffic information based on the traffic information for the single link of the nearest following trip time and the traffic information for the single link of the nearest preceding trip time.

* * * * *